United States Patent [19]

Katoh et al.

[11] Patent Number: 4,944,144

[45] Date of Patent: Jul. 31, 1990

[54] SPINDLE DRIVING DEVICE OF COVERING MACHINE

[75] Inventors: Tadao Katoh, Ishikawa; Akira Yamagiwa, Kanazawa; Eiichi Matsuoka, Matsuto, all of Japan

[73] Assignee: Kabushiki Kaisha Ishikawa Seisakusho, Ltd., Kanazawa, Japan

[21] Appl. No.: 352,943

[22] Filed: May 17, 1989

[51] Int. Cl.[5] ..... D01H 13/00

[52] U.S. Cl. ..... 57/105

[58] Field of Search ..... 57/105, 104; 474/69, 474/77, 132, 133, 135

[56] References Cited

U.S. PATENT DOCUMENTS

| | | | |
|---|---|---|---|
| 455,799 | 7/1891 | Norlin | 474/132 |
| 1,544,033 | 6/1925 | Potter | 57/105 X |
| 2,655,782 | 10/1953 | Cutler | 57/105 |
| 2,783,655 | 3/1957 | Meckoski | 474/77 |
| 3,479,809 | 11/1969 | Herubel | 57/105 |
| 4,781,015 | 11/1988 | Dinkelmann et al. | 57/105 |

FOREIGN PATENT DOCUMENTS

| | | | |
|---|---|---|---|
| 15215 | 11/1934 | Australia | 57/105 |
| 718717 | 1/1932 | France | 57/105 |
| 56-20372 | 5/1981 | Japan . | |
| 1382652 | 2/1975 | United Kingdom | 57/105 |

*Primary Examiner*—Joseph J. Hail, III

*Attorney, Agent, or Firm*—Burns, Doane, Swecker & Mathis

[57] ABSTRACT

A spindle driving device for a covering machine includes a plurality of groups of spindles. Each group of spindles includes a predetermined number of spindles and an electric motor is associated with each group. A driving pulley is removably installed on each motor and a tension pulley is associated with each group of spindles. An endless belt is stretched around the driving pulley, the spindle wharves attached to each spindle and the tension pulley in each group. The tension pulley is mounted at a central portion of an arm and the arm is supported at one end by a pivot which is connected to a slider for movement along a guide-rod for removing slackness in the endless belt. The other end of the arm is attached to an energizing member for biasing the arm in a direction for removing slackness in the endless belt.

6 Claims, 5 Drawing Sheets

SPINDLE DRIVING DEVICE OF COVERING MACHINE

BACKGROUND OF THE INVENTION

1. Field of the Invention

The present invention relates to a covering machine which is arranged to twist covering yarns such as polyamide and nylon yarns around elastic yarns of polyurethane material.

2. Description of Related Art

A basic structure of a covering machine is known in a publication such as Japanese Published Examined Patent Application No. 56-20372. The covering machine is constructed of a multiplicity of spindle elements provided with a multiplicity of core yarn bobbins, spindles, take-up drums and the like.

The spindle is arranged to support a covering yarn bobbin and to rotate by itself, and a prior art spindle driving device is designed as shown in FIG. 5.

To be more precise, the spindle driving device has been designed in such a manner that a multiplicity of spindles 31 are disposed on both sides of the covering machine and an endless belt 34 is stretched between a drive pulley 32 mounted at one end of the covering machine and a driven pulley 33 arranged at another end of the machine. A multiplicity of tension rollers 35 are provided for pressing the endless belt 34 to closely contact each one of the spindles 31. The drive pulley 32 is driven by an electric motor (not shown) to rotate the spindles 31 at a high rate of revolution which corresponds to the rotative movement of the endless belt 34.

However, the spindle driving device used in the conventional covering machines suffers from several problems.

For example, it is difficult to produce various kinds of covering yarns through use of a single covering machine. The difficulty arises because the spindles need to be rotated at a rate corresponding to the number of revolutions suited to each kind of yarn and because there are differences in quality between core yarns and covering yarns. The number of twisting operations required for each kind of yarn differs when the covering operation is performed. The number of revolutions of all spindles in the conventional spindle driving device is, however, arranged to be the same and thus, it is difficult to produce various kinds of covering yarns through use of a single unit of a covering machine.

Also, the endless belt is so long in length that it is difficult to press the belt in the manner necessary to contact each one of the spindles with uniform contact pressure along the entire circumference of the endless belt. Besides, some rotational differences occur among the spindles as a result of the differences in tensile force between the tensioned side and the relaxed side of the endless belt. Accordingly, there occur some differences in the number of twistings of the covering yarns which result from the aforementioned differences in spindles, thereby causing variations in uniformity with respect to the quality of the yarns.

SUMMARY OF THE INVENTION

An object of the present invention is to provide a spindle driving device of a covering machine capable of solving the above-mentioned problems. The number of revolutions of the spindles among each group can be differentially set in a wide range and consequently, increases in manufacturing costs can be kept at a minimum.

In order to accomplish that object, in a spindle driving device of a covering machine provided with a multiplicity of spindles, the present invention includes a multiplicity of spindles being divided into groups, each group being comprised of a predetermined number of spindles. An electric motor is provided for each group and an endless belt is stretched around a drive pulley removably mounted on the electric motor, all of the spindles in the group and a tension pulley. The position of a rear end of an arm which is the center of swing of the arm can be changed for removing slackness in the endless belt, and a tension pulley is installed on the substantially middle portion of the arm. The front end of the arm is energized or biased in the direction necessary to remove slackness in the endless belt.

According to the present invention, the multiplicity of spindles are divided into groups, each of which includes a predetermined number of spindles, for instance, 6–12 per group. One electric motor is provided for each group to rotate the spindles by an endless belt which is driven by the electric motor. By selecting an appropriate outside diameter of the drive pulley which is attached to the motor, the number of revolutions of the spindles belonging to each group ca properly be determined. It thus becomes possible to simultaneously produce various kinds of covering yarns with a single unit of a covering machine since a desired number of revolutions of spindles can be selected for each group. The contact pressure and tensile force to be given to each one of the spindles can be made uniform over the entire circumference of the endless belt since the length of the endless belt is shortened, and as a result, the rotational differences among the spindles belonging to a group is reduced to practically zero, thereby improving the quality of the products.

According to the present invention, it is also possible to change the position of the rear end of an arm that is the center of oscillation in a direction for removing the slackness of the endless belt. A tension pulley is installed on the substantially middle portion of the arm and the front end of the arm is energized or biased in a direction for removing slackness in the endless belt, whereby the tensile force of the endless belt corresponding to the variation of the diameter of the drive pulley can be regulated.

It may be possible to properly select the number of revolutions of the spindles belonging to each group by varying the number of revolutions of the electric motor by use of an invertor. However, the invertor by itself is costly, and moreover, multiple inverters are required for a covering machine thereby causing a considerable increase in the manufacturing cost for the whole unit of the machine. According to the present invention, however, it is possible to utilize a constant speed motor and yet still change the number of revolutions of the spindles by making an exchange of a drive pulley for another drive pulley having a different outside diameter. Furthermore, the structure of the tension pulley used for regulating the tensile force of the endless belt is relatively simple so that an increase in manufacturing cost can be kept at a minimum.

According to the present invention, it is further possible to provide a wider range of adjustment for the tensile force of the endless belt. This is because a larger amount of movement of the tension pulley can be obtained by regulating the position where the basic end of the ar is fixed in addition to the adjustment made by swinging the arm. Accordingly, the tensile force adjustment of the endless belt can be properly made even when drive pulleys which have extremely large differences in outside diameter are exchanged for one another. Consequently, the number of revolutions of the spindles in each group can be varied from group to group.

According to the present invention, in a unit of a covering machine, the number of revolutions of the spindles can be varied among the groups and consequently various kinds of covering yarns can be produced simultaneously. Thus, a spindle driving device of a covering machine capable of keeping an increase in manufacturing cost to a minimum can be provided.

The present invention is applicable to both single and double covering machines. It may also be applicable to a textile machine provided with substantially the same spindle driving device, for instance, a bobbin winder.

These and other objects and features of the present invention will become more apparent from the following description taken in conjunction with the accompanying drawings which illustrate specific embodiments of the invention.

DESCRIPTION OF THE PREFERRED EMBODIMENTS

An embodiment of the present invention will now be described below with reference to the accompanying drawings.

Figure 1:
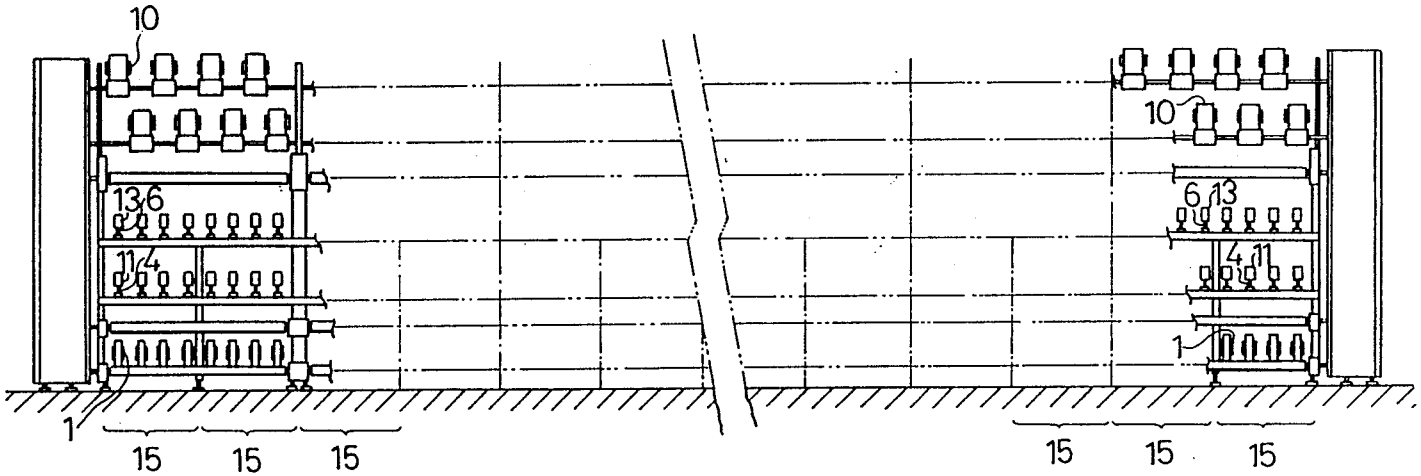
FIG. 1 is a front view showing the whole structure of a double covering machine according to an embodiment of the present invention.
Figure 2:
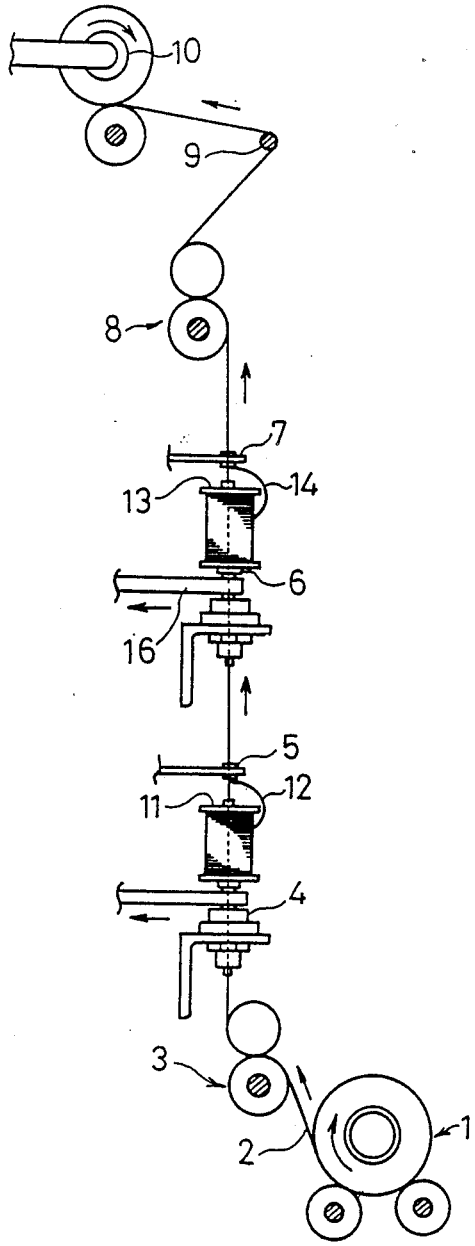
FIG. 2 is a side view showing a covering process of the machine.

FIG. 1 shows a double covering machine. As illustrated in FIG. 2, the double covering machine is designed to draw out upwardly a core yarn 2 fed from a core yarn bobbin 1 and to reel it onto a take-up drum 10 through a first draft roller 3, a first spindle 4 which is hollowed, a first centering guide 5, a second spindle 6 which is hollowed, a second centering guide 7, a second draft roller 8 and a traverse guide rod 9. A first cover yarn 12 fed from a first bobbin 11 mounted on the first spindle 4 and a second cover yarn 14 fed from a second bobbin 13 mounted on the second spindle 6 are wound around the core yarn 2 to cover the core yarn 2.

A process for winding the first cover yarn 12 around the core yarn 2 is performed by winding the first cover yarn 12, which is being drawn out of the first bobbin 11 at a rate corresponding to the rate of rotation of the first spindle 4, onto the core yarn 2 which is being moved upwardly and which is passing through the hollowed portion of the first spindle 4.

A process for winding the second yarn 14 around the core yarn 2 on which the first cover yarn 12 is wound is carried out by winding the second cover yarn 14, which is being drawn out of the second bobbin 13 at a rate corresponding to the rate of rotation of the second spindle 6, onto the core yarn 2 which is being moved upwardly and which is passing through the hollowed portion of the second spindle 6 with the first cover yarn 12 wound thereon.

Thus, the structure of one element for producing yarns comprises the core yarn bobbin 1, the first spindle 4, the second spindle 6, the take-up drum 10 and the like.

The double covering machine comprises a plurality of the elements capable of winding the first cover yarn 12 and the second cover yarn 14 simultaneously onto a multiplicity of core yarns 2. More specifically, eighty take-up drums 10 are provided on each side of the double covering machine thereby comprising one hundred and sixty elements.

Figure 3:
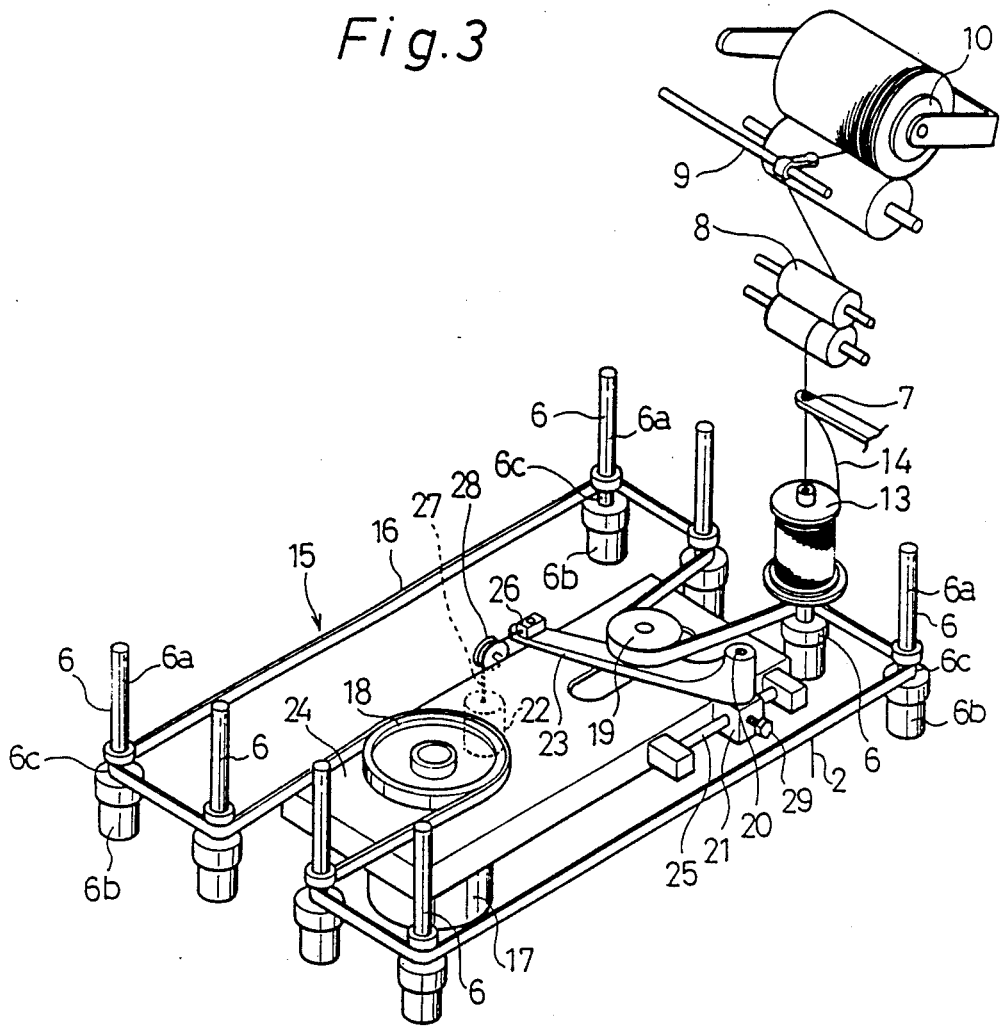
FIG. 3 is a perspective view showing a spindle driving device of a double covering machine.
Figure 4:
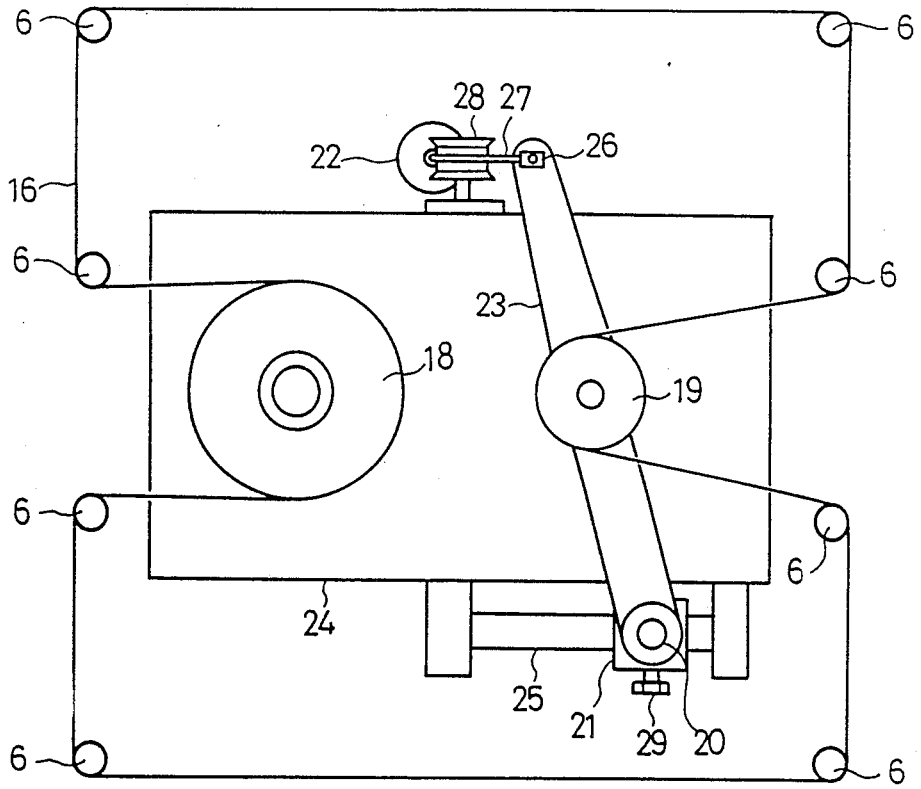
FIG. 4 is a plan view of the spindle driving device.
Figure 5:
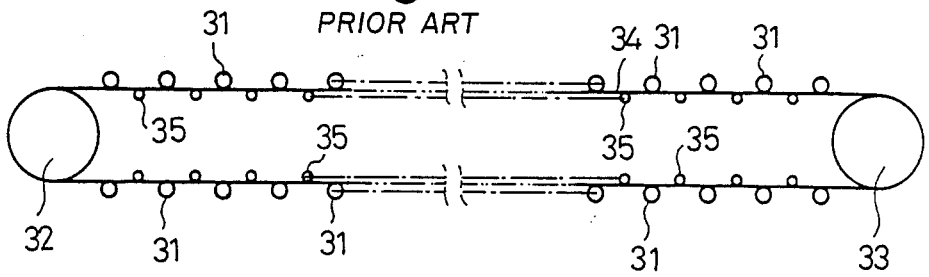
Fig.5 PRIOR ART
FIG. 5 is a plan view showing a spindle driving device according to the prior art.

In this embodiment, the double covering machine includes a multiplicity of the aforementioned elements arranged in twenty units. Each unit 15 includes eight elements. In each one of the units 15, eight of the second spindles 6 are driven by a driving device as shown in FIGS. 3 and 4. In other words, four of the second spindles 6 are disposed at regular intervals on both sides of the double covering machine, and each one of the spindle bodies **6*a* is rotatably held by a bearing portion 6*b* with an endless belt 16 stretched about a wharve 6*c* of the spindle body 6*a***.

The endless belt 16 is stretched around a driving pulley 18 which is detachably mounted on an electric motor 17, each one of the wharves **6*c* and a tension pulley 19 as shown in FIGS. 3 and 4. In that way, the rotation of the electric motor 17 is transmitted to each one of the second spindles 6**.

The number of revolutions of the second spindles 6 can be altered by changing the diameter of the driving pulley 18. For instance, when it is desired that the number of revolutions of the second spindle 6 be lowered, a smaller diameter driving pulley 18 may be utilized. While the use of a smaller diameter driving pulley 18 may cause some slack in the endless belt 16 that slack can be taken up by moving the tension pulley 19.

The tension pulley 19 is mounted on the middle of an arm 23 whose one end is attached to a slider 21 through a pivot 20 and whose other end is affected by the tensile force of a dead weight 22.

Attached to a stand 24 supporting the electric motor 17 is a guide rod 25 which guides the slider 21 and a pulley 28 for guiding a rope 27 which connects the dead weight 22 with a clasp 26 provided at the front end of the arm 23. The guide rod 25 is disposed in the same direction as the direction which effectively eliminates any slack in the endless belt 16, and the slider 21 which is guided by the rod is provided with a set screw 29 to be optionally fixed at any position on the guide rod 25.

The tension pulley 19 is thus mounted on the middle of the arm 23 where it can be swung to center around the pivot 20 of the slider 21. The front end of the arm 23 is affected by the tensile force of the dead weight 22 so that any slack in the endless belt 16 stretched around the tension pulley 19 can always be eliminated.

For some slackness which occurs in the belt 16 when the tension pulley 19 is used for long hours or when the driving pulley 18 is replaced with a driving pulley having only a slightly different outside diameter, the amount of adjustment required for tensioning the endless belt 16 is so small that proper tension can be obtained in the endless belt 16 through the automatic swinging of the arm 23 with the slider 21 fixed at the original position. On the other hand, when the driving pulley 18 is replaced with a driving pulley 18 of much larger diameter, it is necessary to move the slider 21 along the guide rod 25 and fix it at a position sufficient to ensure proper tensioning of the endless belt.

A proper tensile force can thus be given to the endless belt 16 in two ways, by altering the position of the one end of the arm 23 or by swinging the arm 23. The positional relationship between the front end of the arm 23 and the pulley 28 is varied corresponding to the swinging of the arm 23. However, the rope 27 remains properly wound around the pulley 28 even if that positional relationship changes since the clasp 26 is swingably attached at the front end of the arm 23.

Figure 6:
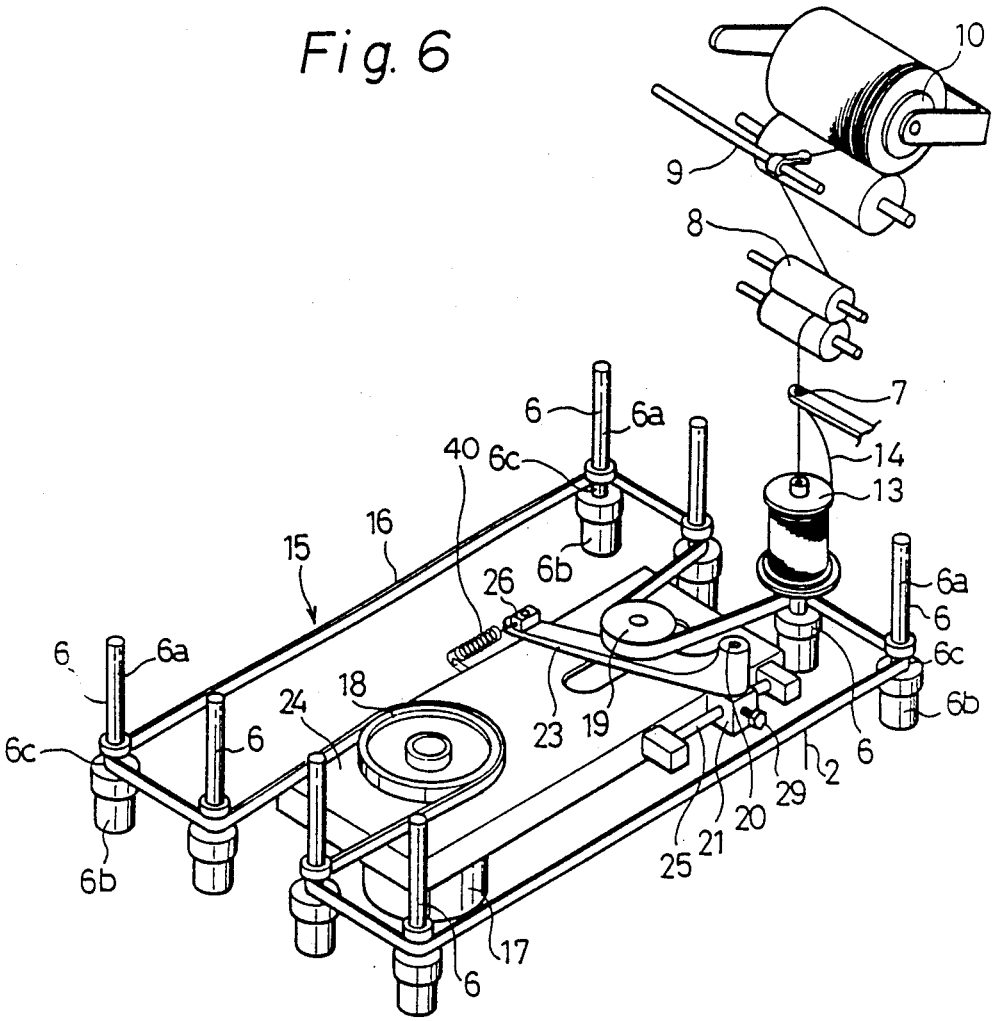
FIG. 6 is a perspective view showing a spindle driving device of a double covering machine according to another embodiment of the present invention.

As a means for energizing or biasing the front end of the arm 23 in the direction necessary to remove the slackness in the endless belt 16, a coil spring or the like may be utilized in place of the dead weight 22. One such exemplary arrangement is shown in FIG. 6 where a spring member 40 is depicted as being secured to the clasp 26 and the supporting stand 24.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations, changes, and equivalents may be made by others without departing from the spirit of the present invention. Accordingly, it is expressly intended that all such variations, changes, and equivalents which fall within the spirit and scope of the present invention as defined in the claims, be embraced thereby.

What is claimed is:

1. A spindle driving device for a covering machine, comprising:

a frame;

a plurality of groups of spindles mounted on the frame, each group of spindles having a predetermined number of spindles and a motor associated therewith;

a spindle-wharve installed on each spindle;

a driving pulley removably installed on each motor, a diameter of the driving pulley being determined according to a necessary speed of revolution of the spindles;

a tension pulley associated with each group of spindles;

an endless belt associated with each group of spindles the endless belt of each group being stretched around the driving pulley, the spindle-wharves and the tension pulley in the respective group;

an arm associated with each group, each arm having the tension pulley of that group mounted at an approximate center thereof;

a pivot supporting one end of each arm, the arm being rotatable around the pivot;

a slider connected to each pivot, said slider being slidable on a guide-rod and being adapted to be fixed at a suitable position along the guide-rod in order to obtain a proper tension in the endless belt, the guide-rod permitting displacement of the slider, the pivot, the arm and the tension pulley in a direction for adjusting the tension in the endless belt;

an energizing member for biasing an opposite end of the arm in a direction adapted to remove slackness in the endless belt.

2. A spindle driving device according to claim 1, wherein the motor is a constant speed motor.

3. A spindle driving device according to claim 1, wherein the driving pulley, the tension pulley, the arm, the guide-rod and the energizing member of each group are mounted on a motor supporting stand.

4. A spindle driving device according to claim 1, wherein said energizing member is a dead weight.

5. A spindle driving device according to claim 1, wherein said energizing member is a spring.

6. A spindle driving device according to claim 1, wherein said motor is an electric motor.

* * * * *